US010221647B2

(12) United States Patent
Rogozinski et al.

(10) Patent No.: US 10,221,647 B2
(45) Date of Patent: Mar. 5, 2019

(54) CEMENT HEAD SYSTEM AND METHOD FOR OPERATING A CEMENT HEAD SYSTEM

(71) Applicant: Halliburton Energy Services, Inc, Houston, TX (US)

(72) Inventors: Nicolas A. Rogozinski, Spring, TX (US); Henry E. Rogers, Duncan, OK (US); Phillip D. Standifer, Duncan, OK (US); Gary J. Makowiecki, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 134 days.

(21) Appl. No.: 15/122,862

(22) PCT Filed: May 5, 2014

(86) PCT No.: PCT/US2014/036816

§ 371 (c)(1),
(2) Date: Aug. 31, 2016

(87) PCT Pub. No.: WO2015/171112

PCT Pub. Date: Nov. 12, 2015

(65) Prior Publication Data

US 2017/0096870 A1 Apr. 6, 2017

(51) Int. Cl.
*E21B 33/068* (2006.01)
*E21B 33/12* (2006.01)
(Continued)

(52) U.S. Cl.
CPC ..... *E21B 33/068* (2013.01); *E21B 33/05* (2013.01); *E21B 33/12* (2013.01); *E21B 33/14* (2013.01); *E21B 34/102* (2013.01)

(58) Field of Classification Search
CPC ..... E21B 33/068; E21B 33/12; E21B 33/14; E21B 34/02
See application file for complete search history.

(56) References Cited

U.S. PATENT DOCUMENTS 4,651,969 A 3/1987 Dowdall
5,236,035 A 8/1993 Brisco et al.
(Continued)

OTHER PUBLICATIONS

Office Action issued for Canadian Patent Application No. 2,943,595 dated Jun. 6, 2017, 3 pages.
(Continued)

*Primary Examiner* — D. Andrews
*Assistant Examiner* — Dany E Akakpo
(74) *Attorney, Agent, or Firm* — Haynes and Boone, LLP

(57) ABSTRACT

A cement head system for wellbores and method for maintaining dynamic fluid flow therethrough, wherein a base station wirelessly drives a control sequence to (1) open cement slurry valves to actuate external visual valve indicators, (2) open upper and lower safety valves, to actuate external visual safety valve indicators, (3) open a lower release chamber to actuate an external chamber visual indicator and to release a plug that triggers an external flipper visual indicator, (4) reset the external flipper visual indicator, (5) open an upper release chamber to actuate an external chamber visual indicator and to release a plug that triggers the external flipper visual indicator; and (6) open and close a release mechanism for each of the upper and lower chamber while pumping a flush fluid through the cement head. Each valve, the release mechanisms and flipper have a controller controlled by the base station.

21 Claims, 5 Drawing Sheets

(51) Int. Cl.

| | |
|---|---|
| ***E21B 34/02*** | (2006.01) |
| ***E21B 33/05*** | (2006.01) |
| ***E21B 33/14*** | (2006.01) |
| ***E21B 34/10*** | (2006.01) |

(56) References Cited

U.S. PATENT DOCUMENTS

| | | | | |
|---|---|---|---|---|
| 5,833,002 | A | 11/1998 | Holcombe | |
| 5,890,537 | A | 4/1999 | Lavaure et al. | |
| 7,252,152 | B2 | 8/2007 | Logiudice et al. | |
| 2008/0296012 | A1 | 12/2008 | Peer et al. | |
| 2010/0282478 | A1 | 11/2010 | Giem | |
| 2011/0168380 | A1 | 7/2011 | Osmundsen et al. | |
| 2011/0232923 | A1 | 9/2011 | Barbee et al. | |
| 2014/0048255 | A1* | 2/2014 | Baca ..... | E21B 33/068 166/250.1 |

OTHER PUBLICATIONS

International Search Report and The Written Opinion of the International Search Authority, or the Declaration, dated Sep. 23, 2014, PCT/US2014/036816, 14 pages, ISA/US.

* cited by examiner

CEMENT HEAD SYSTEM AND METHOD FOR OPERATING A CEMENT HEAD SYSTEM

PRIORITY

The present application is a U.S. National Stage patent application of International Patent Application No. PCT/US2014/036816, filed on May 5, 2014, the benefit of which is claimed and the disclosure of which is incorporated herein by reference in its entirety.

FIELD OF THE INVENTION

The present invention relates generally to cementing heads for introducing cement along with cement plugs into an oil or gas well, and particularly to a cementing head and cementing head control to execute a cementing operation.

BACKGROUND

In the drilling of oil and gas wells, it is common to install a steel pipe or casing within the open wellbore in order to provide stability to the walls of the wellbore passing through the formation and to isolate and seal off formation fluid zones from one another. Typically, the casing is cemented in place in order to bond the casing to the wall of the wellbore. More specifically, a casing string is inserted into a wellbore filled with drilling mud. Once the casing string is positioned in the wellbore, a cementing head is secured to the top of the casing string. The cementing head includes a valve system for injecting and removing fluids during the cementing process and a receptacle(s) or chamber(s) in which at least two plugs are carried. During the cementing process, a first plug, dart, ball or similar device, often referred to as a "bottom plug" is released into the casing string. The first plug is pumped down the casing string by a cement slurry until the first plug seats at a desired location within the casing string (often in proximity to the end of the casing string). As the first plug moves down the casing string, the first plug functions to wipe the casing string of residual mud. In addition, the first plug forms a barrier between the mud in the wellbore below the first plug and cement slurry in the casing string above the first plug. Once the desired amount of cement slurry is pumped into the casing string, a second plug is released at the top of the cement slurry column, thus functioning as a barrier at the top of the cement slurry column. Various types of displacement fluids may be used to apply pressure to the second plug to drive it down the casing string. In so doing, the cement slurry is forced out into the annulus formed between the casing string and the walls of the wellbore, either through ports formed in the casing or through a port in the first plug. As the cement slurry is forced into the annulus, formation fluids and mud contained in the annulus are forced out of the wellbore and recovered at the top of the casing string. After the cementing job is complete, the cementing head if flushed to remove any remaining cement slurry.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. The drawing in which an element first appears is generally indicated by the left-most digit in the corresponding reference number.

DETAILED DESCRIPTION OF THE INVENTION

Figure 1:
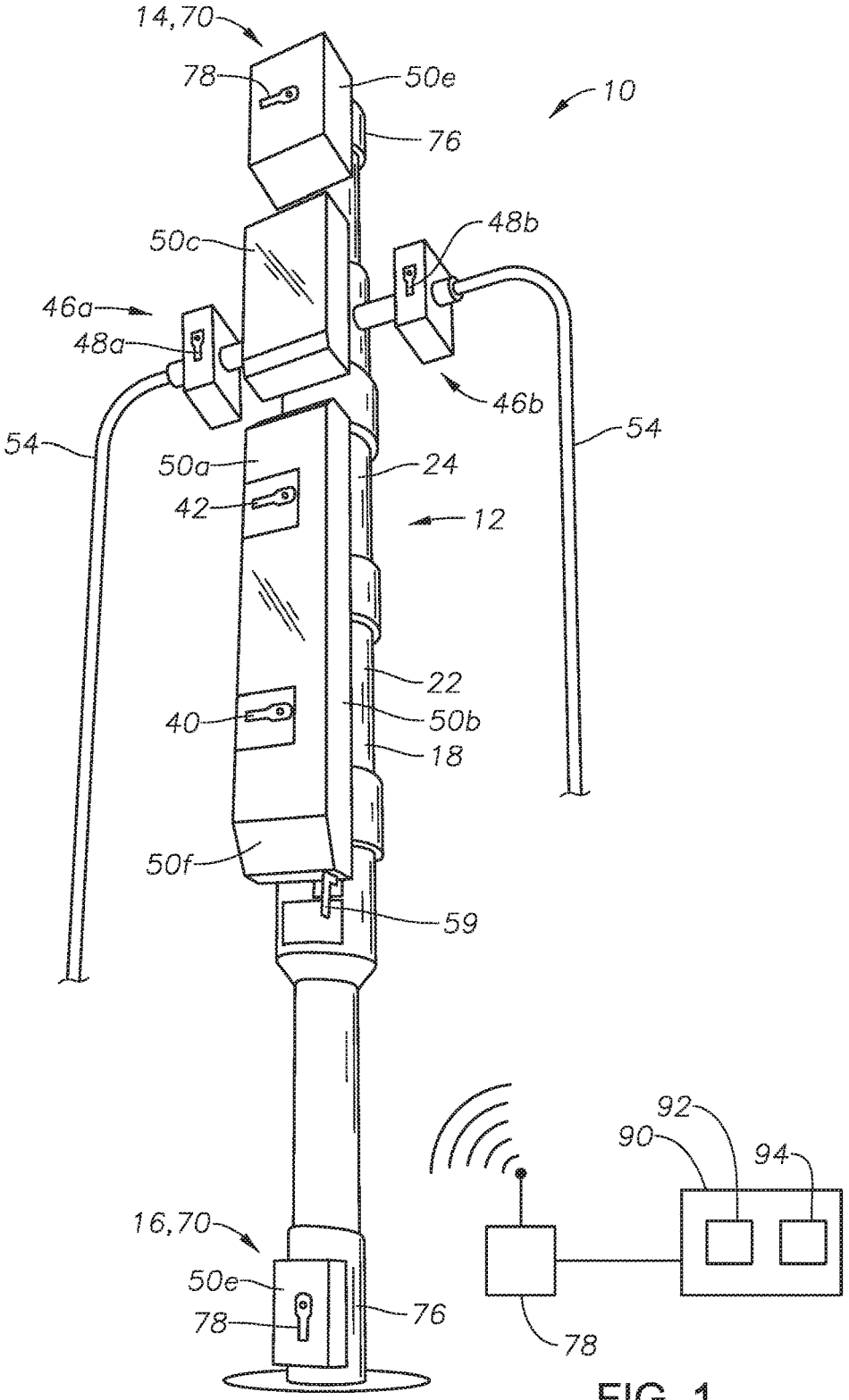
FIG. 1 is an elevation view a cement head assembly installed at the top of a casing string according to an embodiment of the present disclosure.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the FIGS. The spatially relative terms are intended to encompass different orientations of the apparatus in use or operation in addition to the orientation depicted in the FIGS. For example, if the apparatus in the FIGS. is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Figure 2:
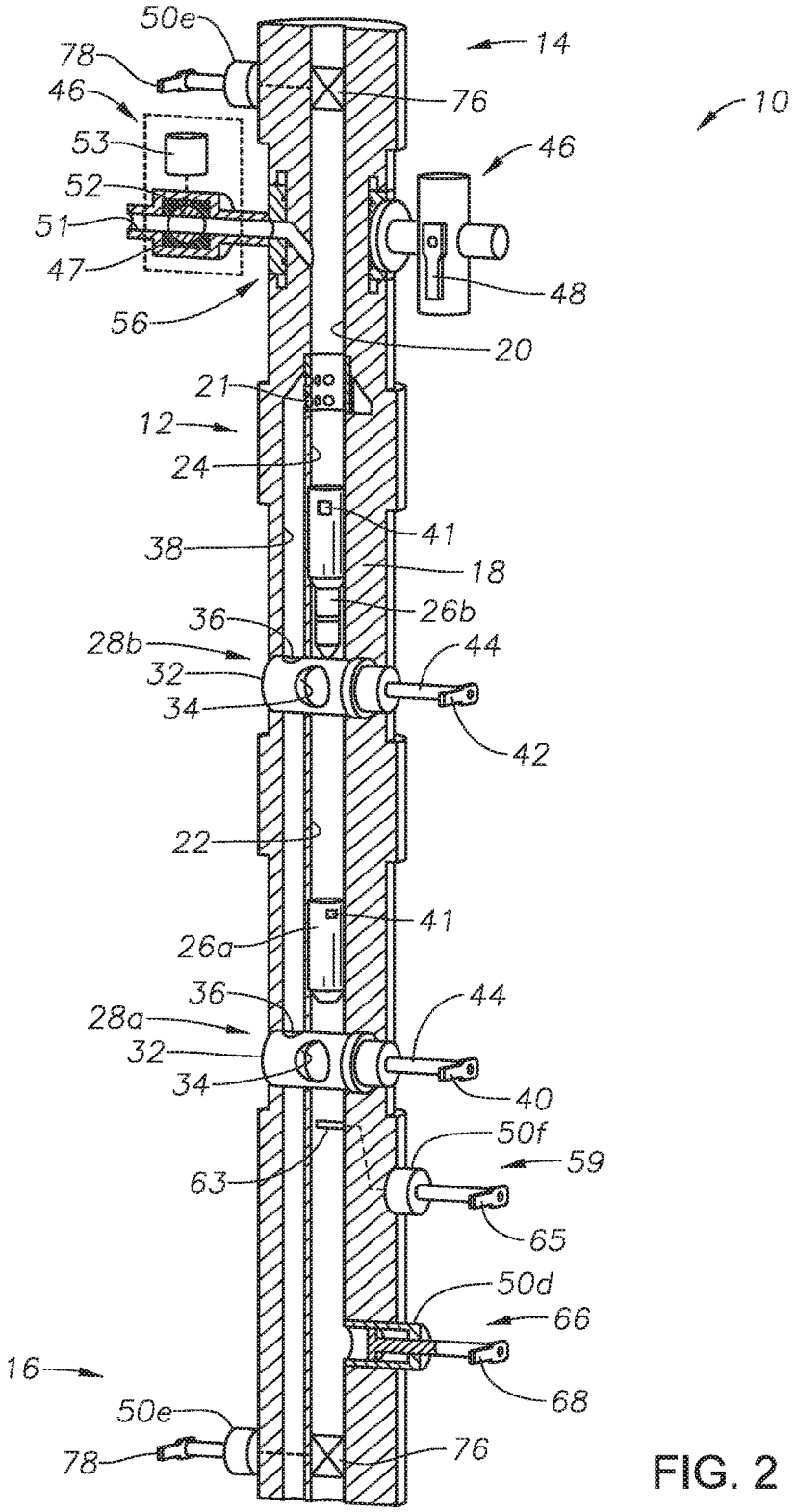
FIG. 2 is a schematic illustration of the cement head assembly of FIG. 1.

Referring initially to FIGS. 1 and 2, a cement head assembly is schematically illustrated and generally designated 10. Cement head assembly 10 generally includes a cement head sub 12 and optionally an upper safety valve system 14 and a lower safety valve system 16. Cement head sub 12 is an elongated tubular 18 having an inner bore 20 extending therethrough. Cement head sub 12 includes a lower or first plug chamber 22 and an upper or second plug chamber 24, each disposed for receipt of a plug, dart, ball or similar device 26 for release downhole. One or both of chambers 22 and 24 may be comprised of a portion of inner bore 20 or may be separately formed and in communication with inner bore 20. A plug release mechanism 28 is disposed in proximity to each of first chamber 22 and second chamber 24 to secures plugs 26*a*, 26*b* in their respective chambers and which can be activated to release plug 26 through inner bore 20.

In some embodiments, chambers 22 and 24 each comprise a portion of inner bore 20. Associated with lower plug chamber 22 is a lower release mechanism 28*a* and associated with upper plug chamber 24 is an upper release mechanism 28*b*. Each release mechanism 28 includes a release element 32 movable between a first position (closed) to secure a plug in an associated chamber, 22, 24 and a second position (open) to release a plug from the associated chamber 22, 24. In some embodiments, movable release element 32 is a rotatable cylindrical element having a first radial through bore 34. In some embodiments, rotatable cylindrical element 32 may also include an internal flow passage 36. Rotatable element 32 is radially positioned at the lower end of each chamber 22, 24 and rotatable between a first closed position (shown) in which bore 34 is offset from bore 20, and a second release position (not shown) in which bore 34 is aligned with bore 20.

In some embodiments a fluid flow bypass passage 38 may also be defined in cement head sub 12. Fluid flow passage may extend substantially parallel with bore 20 with a first port 21 in fluid communication with bore 20 above upper chamber 24, thereby permitting fluid flow to bypass upper chamber 24, as desired. In some embodiments, a portion of rotatable element 32 extends into fluid flow passage 38 and rotatable between a first position (not shown) in which internal flow passage 36 is closed from fluid communication with bypass passage 38, and a second open position (shown) in which internal flow passage 36 is in fluid communication with flow bypass passage 38. In the second open position, internal flow passage 36 within cylindrical element 32 is also in fluid communication with inner bore 20 below lower chamber 22, thereby permitting fluid flow to lower chambers 22. Thus, mud flow and/or fluid pressure on the mud column within the wellbore can be maintained through cement head assembly 10 until the cementing operations begin by initiating the cementing sequence discussed below.

In any event, release mechanism 28 preferably also includes a position indicator, such as is illustrated by lower indicator 40 and upper indicator 42. Each indicator 40, 42 provides an external visual indication of the alignment of bore 34 relative to bore 20. In some preferred embodiment, indicator 40, 42 extends along an axis substantially parallel with the axis of bore 34 of release mechanism 28*a*, 28*b*. An indicator 40, 42 may be carried on a spindle 44 axially extending from rotatable element 32.

Finally, each release mechanism 28 preferably includes an electronic controller 50 for actuation of the release mechanism 28, such as is illustrated by upper release controller 50*a* and lower release controller 50*b*. In some embodiments, release mechanism 28 is actuated by an actuation mechanism such as an electric, hydraulic or pneumatic motor driven by a controller 50 (see actuation mechanism 53 of FIG. 2 associated with valve 46), which may also be used to move indicators 40, 42. It will be appreciated that because of the environment in which cement heads are deployed, it is difficult to provided wired power and communications to the cement head. Although the electronic controller 50 may be wired to receive control signals via an electrical conductor, in preferred embodiments, electronic controller 50 is wireless, utilizing wireless protocol known in the art. The wireless protocol referred to herein is not limited to a particular type, but includes any transmission by radio waves. For purposes of the illustration, in FIG. 2, not all controllers 50 or actuation mechanisms are illustrated. Likewise, components of a controller, such as controller 50, are understood in the art and are not described in detail herein.

Persons of ordinary skill in the art will appreciate that while it is desirable that cement head sub 12 include at least two plug chambers, cement head sub 12 may include fewer chambers or more chambers. For example, a third chamber with a corresponding release mechanism may be included.

Cement head sub 12 also includes at least one, and preferably two or more cement slurry valves 46. The foregoing disclosure is not limited to any particular valve type, but for purposes of illustration, in some embodiments, each valve 46 includes a valve seat 47 disposed along a through bore 51 in fluid communication with bore 20. Disposed in valve seat 47 is a valve element 52 movable by an actuation mechanism 53, such as a motor driven by a controller 50, between a first closed position and a second open position. Slurry valve 46 preferably includes a position indicator 48. Position indicator 48 provides an external visual indication of the position of valve element 52 within bore 51 and is movable in conjunction with valve element 52. In some preferred embodiment, when valve element 52 is in an open position, indicator 48 extends along an axis substantially parallel with the axis of bore 51, and when valve element 52 is in a closed position, the axis of indicator 46 is substantially perpendicular to the axis of bore 51. A slurry line 54 is in fluid communication with bore 51 of valve 46. FIG. 1 illustrates a cement head assembly 10 with two slurry valves 46, namely a first slurry valve 46*a* and a second slurry valve 46*b*.

Each cement slurry valve 46 preferably includes an electronic controller 50 for actuation of the slurry valve, such as is illustrated by slurry valve controller 50*c*.

Figure 3:
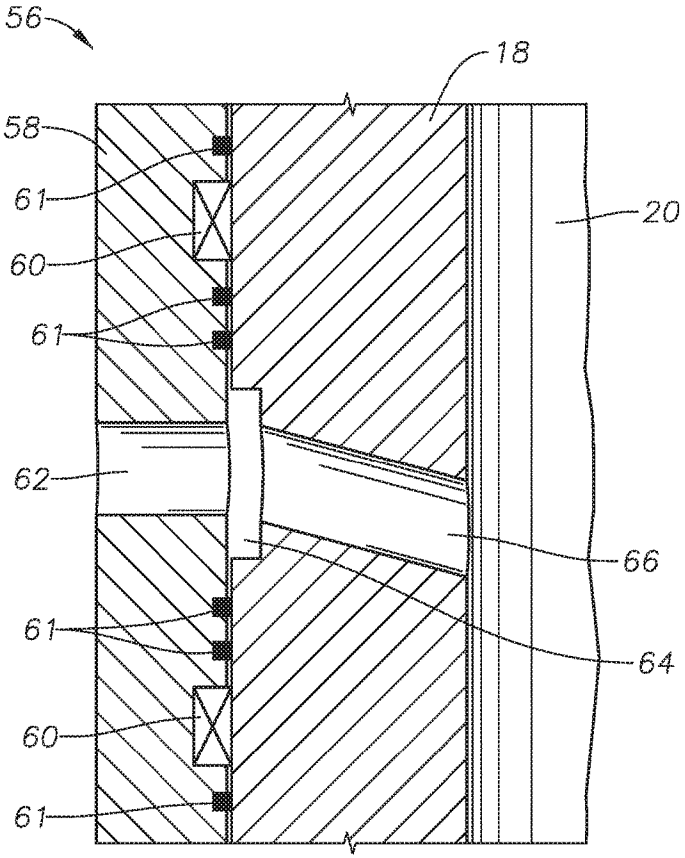
FIG. 3 is a schematic illustration of a slurry valve swivel for the cement head assembly of FIG. 1.

In some embodiments, valve 46 is secured to a swivel 56 carried by cement head sub 12 as shown in greater detail in FIG. 3. Swivel 56 is comprised of a sleeve 58 rotatably mounted on elongated tubular 18 via bearings 60. Seals 61 may be provided between sleeve 58 and tubular 18. A port 62 in sleeve 58 aligns with bore 50 of valve 46. Port 62 opens into a circumferentially extending cavity 64 defined along a portion of the inner surface of sleeve 58. Sleeve 58 is carried on tubular 18 so that cavity 64 is in fluid communication with one or more inlets 66 defined in elongated tubular 18. Inlets 66 are in turn in fluid communication with inner bore 20 of elongated tubular 18. As swivel 56 rotates about elongated tubular 18, fluid communication between bore 20 and valve 46 can be maintained, as desired.

Positioned along elongated tubular 18 below lower chamber 22 is a flipper mechanism 59. In some embodiments, flipper mechanism 59 is dynamic and is physically engaged by a plug 26 passing through bore 50. For example, in some embodiments, flipper mechanism 59 may generally include an arm or extension 63 movably mounted on tubular 18 so that arm 63 protrudes into bore 50 when arm 63 is in a first position and is at least partially retracted from bore 50 when arm 63 is in a second position. Linked to arm 63 is a visual indicator 65 mounted on the exterior of tubular 18. Visual indicator 65 is movable between a first position corresponding to the first position of arm 63 and a second position corresponding to the second position of arm 63. As a plug 26 moves past arm 63 in bore 20, the plug drives arm 63 from its first position to its second position. Visual indicator 65 thereby provides an indication that a plug 26 has moved past flipper mechanism 59 following release of plug 26 from its corresponding chamber. In some embodiments, an electronic controller 50, such as is illustrated by flipper controller 50*f*, may be utilized to move flipper mechanism 59 to the first position to thereby "reset" flipper mechanism 59 once a plug 26 moves flipper mechanism 59 to the second position. In another embodiment, flipper mechanism 59 may simply be a stationary proximity sensor, reader or similar static device disposed to identify a plug 26 passing adjacent thereto and which in turn causes visual indicator 65 to move between a first position and a second position. In these embodiments, plug 26 and visual indicator 65 may include a trigger mechanism 41 to actuate movement of the visual indicator 65. Trigger mechanism is not limited to a particular type of device, but may include be a magnet system or an RFID chip and reader system disposed to cause actuation of the visual indicator 65 when plug 26 passes flipper mechanism 59. In any case, flipper controller 50*f* is disposed to reset flipper mechanism 59, and hence visual indicator 65, once it has been moved to the second position.

Figure 4:
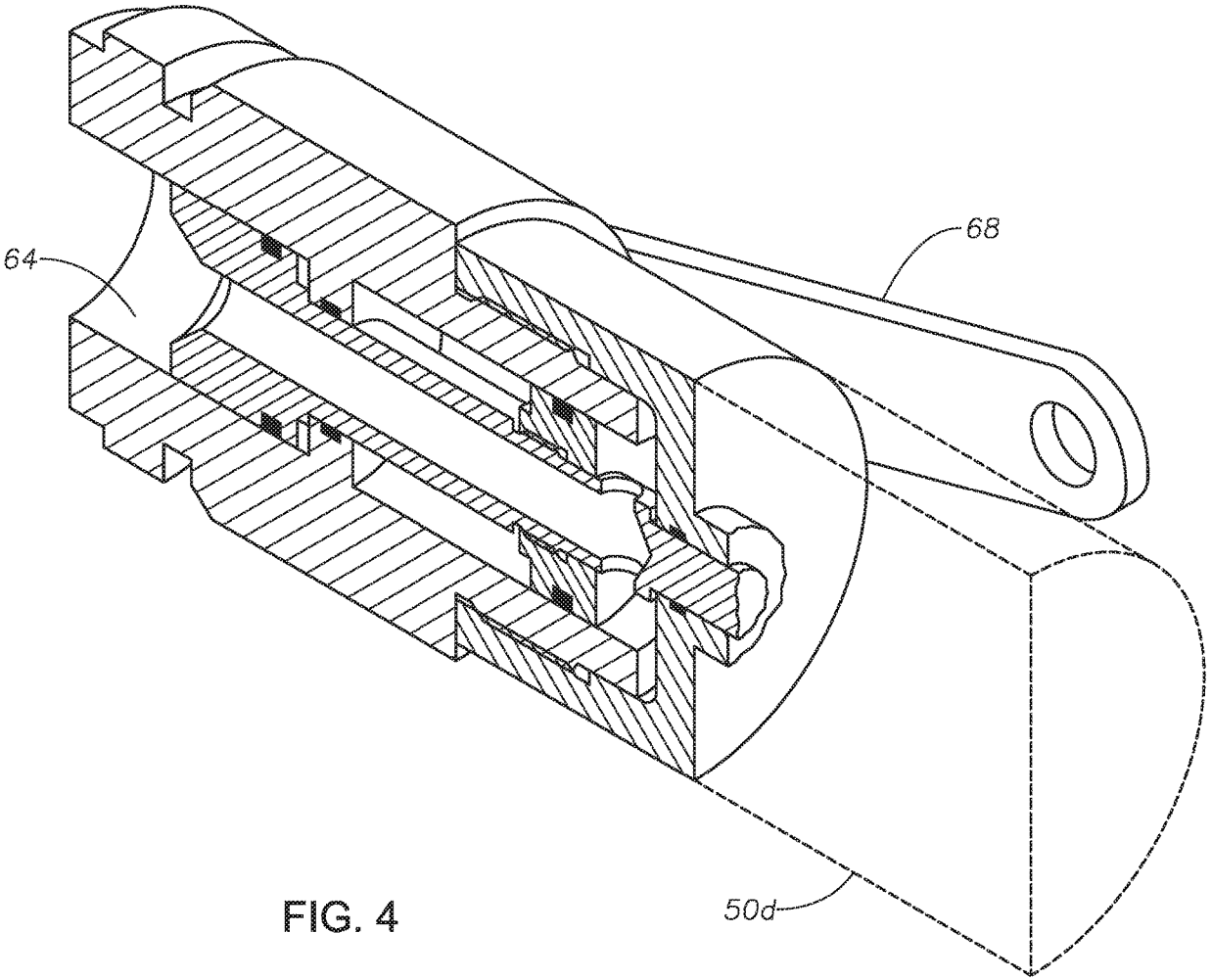
FIG. 4 is a schematic illustration of a release mechanism for the cement head assembly of FIG. 1.

Positioned along elongated tubular 18 below flipper mechanism 59 is an additional chamber 64 and release mechanism 66, as illustrated in FIG. 4. Similar to first and second plug chambers 22, 24, chamber 64 is disposed for receipt of a plug, dart, ball or similar device 26 for release downhole. Chamber 64 is in communication with inner bore 20, however, unlike chambers 22, 24, chamber 64 is separate from bore 20 so as not to interfere with the order of release of plugs 26 from chambers 22, 24. Release mechanism 66 secures a plug (not shown) in chamber 66 and can be activated to release the plug into inner bore 20. Release mechanism 66 preferably also includes a position indicator, such as is illustrated by indicator 68 which provides an external visual indication of the state, i.e., open or closed, of release mechanism 66. Finally, release mechanism 66 preferably includes an electronic controller 50 for actuation of the release mechanism, such as is illustrated by release controller 50*d*.

Figure 5:
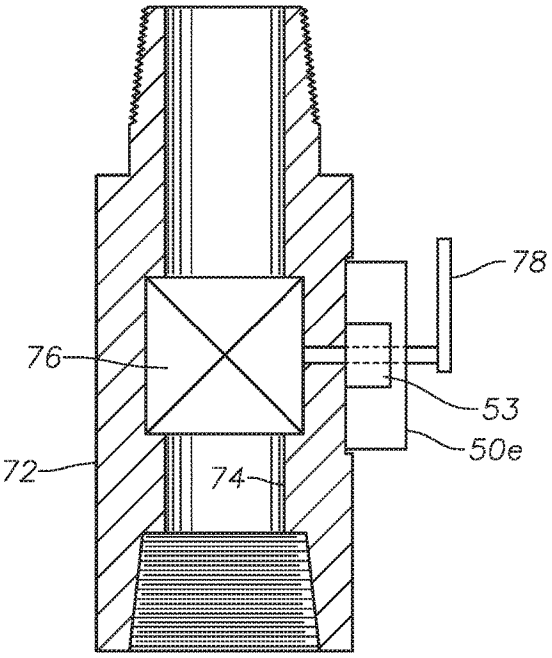
FIG. 5 is a schematic illustration of a safety valve system for the cement head assembly of FIG. 1.

In some embodiments, one or more safety valve systems 70, as illustrated in FIG. 5, may be joined to elongated tubular 18. The safety valves system 70 includes a safety valve sub 72 with a through bore 74 in communication with bore 20 of elongated tubular 18. A valve 76 is disposed along bores 74 and is movable between an open which permits flow through the valve 76 and a closed position which prevents flow through valve 76. Safety valve systems 70 preferably also includes a position indicator, such as is illustrated by indicator 78 which provides an external visual indication of the state, i.e., open or closed, of valve 76. Finally, safety valve systems 70 preferably includes an electronic controller 50 for actuation of the release mechanism, such as is illustrated by release controller 50*e*. In FIG. 1, two safety valve systems 70 are depicted, namely an upper safety valve system 14 attached to the upper end of elongated tubular 18 and a lower safety valve system 16 attached to the lower end of elongated tubular 18.

Finally, a base station 78, shown in FIG. 1, is disposed to communicate with each controller 50. As mentioned above, although base station 78 may be in wired communication with each controller 50, preferably the communication is via a wireless radio link. Base station 78 is not limited to a particular type of communications unit, but can comprise any unit disposed to wirelessly transmit radio signals to one or more controllers 50. In some embodiments, base station 78 may be a portable communications device such as a mobile phone or tablet or the like. Likewise, the invention is not limited to a particular wireless protocol. In some embodiments, the wireless protocol may be Wi-Fi, Bluetooth, Z-Wave or Zigbee. In some embodiments, base station 78 is programmed with a computer program that implements a control sequence in order to maintain dynamic operation of cement head assembly 10 during a cementing process. By utilizing base station 78 to maintain dynamic fluid flow or dynamic operation, i.e., having fluid moving through the cement head assembly 10 during at least various portions of the cementing process if not the entire cementing process, a particular cementing job can be completed faster, while minimizing potential error in operation of the cement head assembly 10. In other words, the cement head assembly 10 is controlled in such a manner as to insure that either cement fluid, displacement fluid or flush fluid is flowing through cement head assembly 10 during a particular cementing process once a control sequence has been implemented.

Figure 6:
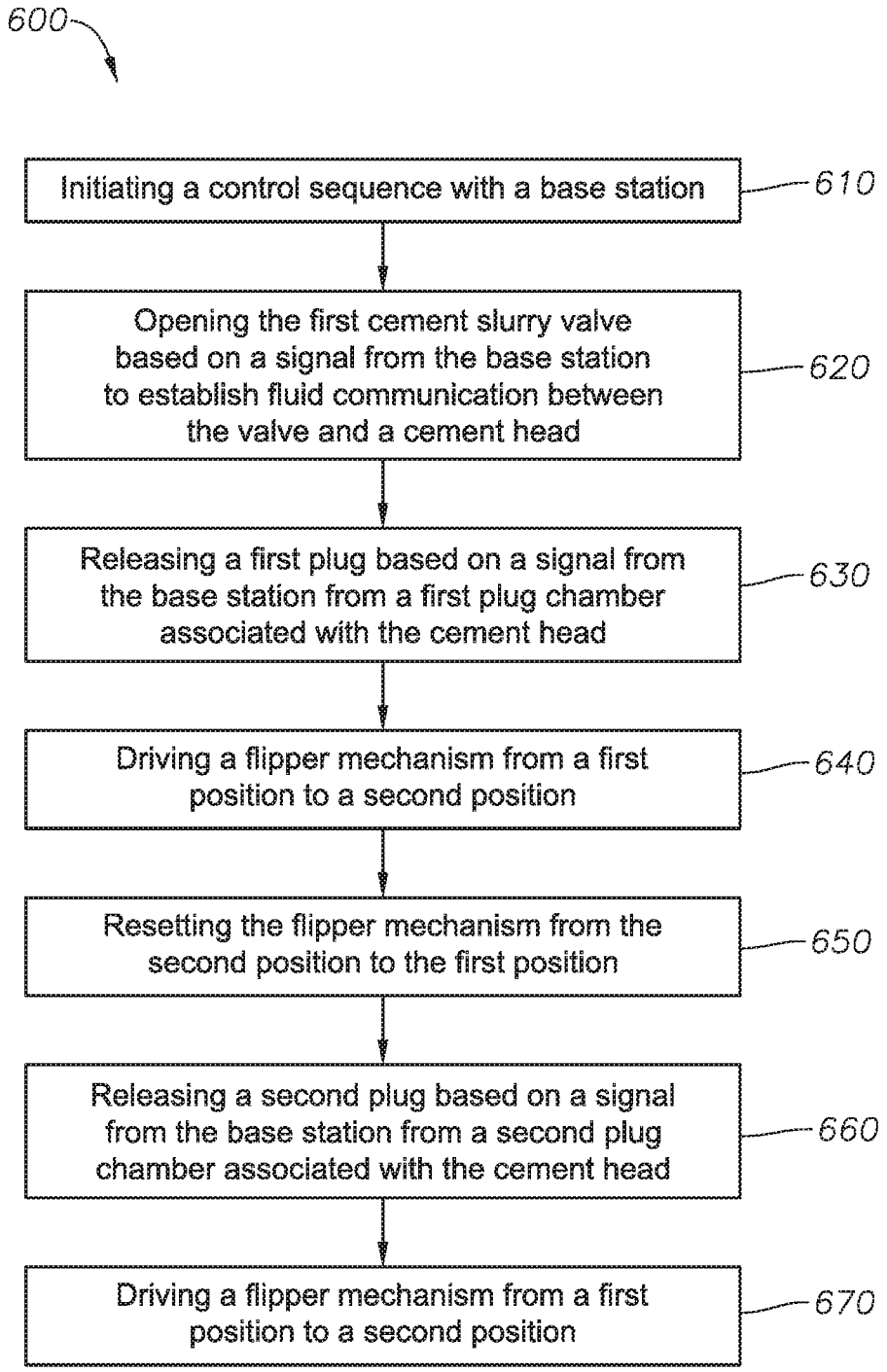
FIG. 6 is a flow chart of a method for conducting cementing operations according to an embodiment of the present disclosure.

Turning to FIG. 6, steps in a cementing method 600 for a wellbore are illustrated. Base station 78 is utilized to implement a control sequence in order to maintain dynamic operation of cement head assembly 10 during a cementing process. Thus, in step 610 a control sequence for operating cement head assembly 10 is initiated by base station 78. As discussed above, it may be desirable to prior to initiating a control sequence for cementing operations, to maintain mud or fluid flow and/or pressure in the wellbore. In such case, slurry valves 46 are maintained in a closed position and upper safety valve 14 and lower safety valve 16 are open so that drilling mud can be pumped under pressure through cement head assembly 10 via bypass passage 38 to the wellbore below. At the initiation of the control sequence, therefore, base station 78 may cause cement head assembly 10 to be placed in an initial configuration where all cement slurry valves 46 are in a closed position, as are upper safety valve system 14 and lower valve safety system 16, while flipper mechanism 59 is oriented in a first position where arm 60 protrudes into bore 50 of cement head assembly 10. Following the initiation of the control sequence in step 610, in step 620, a first slurry valve 46 is opened upon a signal from base station 78. Specifically, electronic controller 50*c* is activated based on the signal to drive valve 46*a* from a closed position to an open position. In one or more embodiments, electronic controller 50*c* is wireless, operable by a radio signal and is activated by sending a wireless command from base station 78 to electronic controller 50*c*. As electronic controller 50*c* drives valve 46*a* to an open position, position indicator 48*a* moves from a first position to a second position. In the first position, indicator 48*a* provides an external visual indication that valve 46*a* is closed. In the second position, indicator 48*a* provides an external visual indication that valve 46*a* is open. Although first slurry valve 46*a* is open, slurry lines 54 are not pressurized and thus, slurry will not flow unit slurry is pumped to the valves via slurry lines 54. In the control sequence, lower safety valve system 16 is opened following opening of slurry valves 46.

In an optional next step, additional slurry valves 46 may be opened. These additional slurry valves 46 either may be opened simultaneously with the opening of first slurry valve 46*a* or in consecutive order. As with the first slurry valve 46*a*, these additional slurry valves 46 are each opened using an electronic controller 50*c* associated with the valve and each valve includes a visual indicator 48 to indicate the orientation of its corresponding valve element 52. In FIG. 1, an additional slurry valve 46*b* having an external visual indicator 48*b* is illustrated.

Likewise, in an optional next step, either preceding or following opening of the slurry valves 46, the lower safety valve system 16 is opened via a control signal from base station 78. Specifically, electronic controller 50*e* of lower safety valve system 16 is activated, thereby driving valve 76 of lower safety valve system 16 from a closed position to an open position. In preferred embodiments, electronic controller 50*e* is wireless, operable by a radio signal and is activated by sending a wireless command from base station 78. As electronic controller 50*e* drives valve 76 of lower safety valve system 16 to an open position, the associated position indicator 78 moves from a first position to a second position. In the first position, indicator 78 provides an external visual indication that valve 76 of lower safety valve system 16 is closed. In the second position, indicator 78 of lower safety valve system 16 provides an external visual indication that valve 76 is open. The opening of lower safety valve system 16 opens a flow path from the cement head assembly 10 to the wellbore below.

In an optional next step, either preceding or following opening of the lower safety valve system 16, the upper safety valve system 14 is closed based on a control signal from base station 78, thereby isolating the cement head assembly 10 from the rig works (not shown). Although described as being closed after the opening of lower safety valve system 16, in other preferred embodiments, upper safety valve system 14 may be closed before or simultaneously with the opening of the lower safety valve system 16 in some embodiments. Likewise, lower safety valve system 16 may be opened and upper safety valve system 14 may be closed before or simultaneously with opening of the slurry valve 46. In any event, electronic controller 50*e* of upper safety valve system 14 is activated, thereby moving the associated valve 76 of upper safety valve system 14 from an open position to a closed position. In preferred embodiments, electronic controller 50*e* is wireless, operable by a radio signal and is activated by sending a wireless command from base station 78. As electronic controller 50*e* drives valve 76 of upper safety valve system 14 to a closed position, position indicator 78 of upper safety valve system 14 moves from a second position to a first position. In the first position, indicator 78 of upper safety valve system 14 provides an external visual indication that valve 76 of upper safety valve system 14 is closed. In the second position, indicator 78 provides an external visual indication that valve 76 of upper safety valve system 14 is open. It will be appreciated that the opening of upper safety valve system 14 opens a flow path from the cement head assembly 10 to the rig works above. Conversely, in a closed position, upper safety valve system 14 blocks flow of cement up the pipe string and isolates the cement head assembly 10.

If it is not already in its first or "reset" position, prior to activation of either the upper or lower release mechanisms 28*a*, 28*b*, flipper mechanism 59 is moved to its first position so that arm 60 protrudes into bore 50 and visual indicator 62 is its first position. Flipper mechanism 59 may be activated with an electronic controller 50 via a control signal from base station 78.

Once the slurry valve(s) 46 are opened as desired in step 620, and the lower and upper safety valves 16, 14, are opened and closed, respectively, the next step 630 in the control sequence is to activate lower chamber release mechanism 28*a*, thereby causing the lower chamber release visual indicator 40 adjacent the cement head to be driven from a first position to a second position and permitting plug 26*a* to be released down bore 50. Specifically, lower chamber electronic controller 50*b* is activated based on a control signal from base station 78 to move lower plug release mechanism 28*a* from a closed position to an open position. In those embodiments employing a rotatable cylindrical element 32 and described above, bore 34 of rotatable cylindrical element 32 is aligned with bore 20 of tubular 18, thereby allowing plug 26*b* to be released downhole. In any event, as plug 26*a* passes in proximity to flipper mechanism 59, plug 26*a* engages arm 63 of flipper mechanism 59, driving flipper mechanism 59 from a first position to a second position, as at step 640. In this second position, visual indicator 65 of flipper mechanism 59 is oriented to indicate that a plug has past flipper mechanism 59.

In any event, simultaneously with the release of plug 26*a* by activation of lower chamber release mechanism 28*a*, or otherwise following the release of plug 26*a*, cement slurry flow through valves 46 is initiated. The cement slurry flows into bypass channel 38. Since upper chamber release mechanism 28*b* being in the closed position, the internal flow passage 36 of upper chamber release mechanism 28*b* is therefore in fluid communication with bypass channel 38. Thus, cement slurry flows through internal flow passage 36 and into bore 20 behind the released lower plug 26*a*. It will be appreciated that internal flow passage 36 allows the slurry flow to bypass around upper chamber 24.

In some embodiments, a portion of the cement slurry also flows into upper chamber 24 behind upper plug 26*b*.

Once the desired amount of cement slurry has been pumped into the wellbore behind the released lower plug 26*b*, cement slurry pumping is terminated and, at step 650, a control signal is sent from base station 78 to flipper controller 50*f* to reset flipper mechanism 59 for the next plug 26 and drive visual indicator 65 of flipper mechanism 59 back to a first position. As described above, in its first or "reset" position, for those embodiments of flipper mechanism 59 employing an arm 63, arm 63 extends into bore 20 to be engaged by the next plug 26 passing flipper mechanism 59. Although flipper mechanism 59 can be reset at any time, preferably it is reset after flow through bore 20 has been terminated so as not to interfere with the slurry flow.

With flipper mechanism 59 reset, at step 660, upper chamber electronic controller 50*a* is activated via a control signal from base station 78, thereby causing the upper chamber release visual indicator 42 adjacent the cement head to be driven from a first position to a second position and driving upper plug release mechanism 28*b* from a closed position to an open position. In so doing, for those embodiments employing a rotatable cylindrical element 32, bore 34 of rotatable cylindrical element 32 is aligned with bore 20 of tubular 18, thereby allowing upper plug 26*b* to be released. Since lower release mechanism 28*b* is still in its second position, released upper plug 26*b* will pass through radial bore 34 of lower release mechanism 28*b* and drop downhole through bore 20. As plug 26*b* passes in proximity to flipper mechanism 59, plug 26*b* engages arm 63 of flipper mechanism 59, driving flipper mechanism 59 from a first position to a second position, as at step 670. In this second position, visual indicator 65 is oriented to indicate that a plug has past flipper mechanism 59.

To the extent any cement slurry was in upper chamber 24 behind plug 26*b*, the cement slurry will be released and follow plug 26*b* down into the wellbore to encase plug 26*b*.

In some embodiments, a displacement fluid may be pumped into cement head assembly 10 to help drive released upper plug 26*b* downhole. The displacement fluid may be pumped through slurry valves 46 and/or through a top drive (not shown) above upper safety valve 14. To the extend the displacement fluid is pumped from a top drive, upper safety valve 14 is opened to allow the displacement fluid to pass therethrough. In one or more embodiments, upper safety valve 14 may be opened and displacement fluid pumped through cement head assembly 10 simultaneously with the release of plug 26*b* from upper chamber 24. Likewise, in some embodiments, electronic controller 50*c* may be activated by base station 78 to close slurry valves 48 during injection of the displacement fluid through upper safety valve assembly 14.

In some embodiments, the control sequence from base station 78 continues in order to flush cement head assembly 10 of residual cement slurry that may be remaining therein. Specifically, upper chamber electronic controller 50*a* is activated by a control signal from base station 78 to drive upper plug release mechanism 28*b* back to its first position in which upper chamber 24 is closed and inner flow passage 36 fluidly connects bypass passage 38 with bore 20 below upper chamber 24. In so doing, the cement slurry remaining in bypass passage 38 is released downhole where it further encases plug 26 for subsequent drilling. Next, upper chamber electronic controller 50*a* is activated again to drive upper plug release mechanism 28*b* back to its closed configuration. In this regard, upper chamber electronic controller 50*a* may be toggled once or multiple times to open and close upper plug release mechanism 28*b* to release any cement slurry that might be remaining. Preferably during this step, displacement fluid or a flush fluid is pumped through cement head assembly 10 to flush any cement slurry therefrom. In some embodiments, upper plug release mechanism 28*b* may be opened and closed at least 3 times with the flush fluid passing therethrough.

In this same vein, lower plug release mechanism 28*a* is actuated via lower electronic controller 50*b* and cycled at least once and preferably multiple times between opened can closed configurations with flush fluid passing therethrough. In some embodiments, lower plug release mechanism 28*a* may be opened and closed at least 3 times during this part of the control sequence. Again, preferably displacement fluid or a flush fluid is pumped through cement head assembly 10 as lower plug release mechanism 28*a* is actuated during this portion of the sequence.

Finally, if they have not already been closed, all cement slurry valves 46 are driven by their respective controllers 50 to a closed position based on a control signal from base station 78. Upper safety valve system 14 and lower valve safety system 16, as well as upper and lower plug release mechanisms 28, to the extent they comprise bore 20, may be left in their open configuration to permit ongoing operations through the top drive.

Dynamic fluid flow through the cement head assembly may be maintained for at least a portion of a cementing operation by opening and closing various valves, releasing plugs, pumping fluids and flushing the cement head so that at fluid flow is maintained during the transition between at least two different fluids during at least a portion of the control sequence. In other words, components of the cement head assembly may be operated to ensure that as flow of one fluid is being suspended, flow a another fluid is being initiated. Thus, in some embodiments, at least two of the steps of opening, releasing, pumping and flushing may occur simultaneously or in near simultaneous succession.

In some embodiments, base station 78 may include a computer system 90 adapted for implementing the cementing method control sequence as described herein in order to maintain dynamic operation of cement head assembly 10 during a cementing process. In some embodiments, the computer system 90 includes at least one processor 92, and a non-transitory, computer-readable storage 94. Software instructions executable by the processor 92 for implementing the control sequence in accordance with the embodiments described herein, may be stored in storage 104. It will also be recognized that the software instructions comprising the control sequence may be loaded into storage 104 from a CD-ROM or other appropriate storage media.

Thus, various embodiments of a cement head system for wellbores have been described. These embodiments of the cement head system may generally include a cement head sub comprising an elongated tubular having an inner bore extending therethrough; a first plug chamber in communication with the inner bore at a select location along the bore; a first plug release system comprising a movable plug release element disposed adjacent the first plug chamber, a first plug release controller operable to move the plug release element from a first position in which the first plug chamber is closed and a second position in which the first plug chamber is open, and visual indicator linked to the movable release element; a first cement slurry valve in fluid communication with the inner bore, the first cement slurry valve comprising a movable valve element, a first slurry valve controller operable to move the valve element and visual indicator linked to the movable valve element; and a control base station in communication with the slurry valve controller and the plug release controller. Likewise, other embodiments of a cement head system for wellbores have been described. These embodiments of a cement head system may generally include a cement head sub comprising an elongated tubular having an inner bore extending therethrough and a fluid bypass passage extending substantially parallel with the bore, the bypass passage having a first port in fluid communication with the bore; a first plug chamber and a second plug chamber, each formed by a portion of the inner bore at distinct select locations along the bore, wherein the first chamber is above the second chamber; a first plug release system adjacent the first chamber and a second plug release system adjacent the second chamber, each plug release system comprising a movable plug release element disposed adjacent the respective plug chamber, a plug release controller operable to move the associated plug release element from a first position in which the associated plug chamber is closed and a second position in which the associated plug chamber is open, and visual indicator linked to the associated movable release element, wherein each movable plug release element is a rotatable cylinder having a radial through bore disposed to substantially align with the inner bore of the cement head sub when the associated movable plug release element is in the second position, the rotable cylinder further including a fluid flow passage therethrough which forms a fluid communication path between the bypass passage and the inner bore when the plug release is in the first position and blocks fluid communication therethrough when first release is in the second position; a first cement slurry valve in fluid communication with the inner bore, the first cement slurry valve comprising a movable valve element, a first slurry valve controller operable to move the valve element and visual indicator linked to the movable valve element; a flipper mechanism mounted adjacent or in proximity to the cement head sub, the flipper mechanism comprising a movable visual indicator and a flipper controller operable to move the visual indicator; and a control base station in wireless communication with the slurry valve controller, the flipper controller and the plug release controllers.

For any of the foregoing embodiments, the cement head systems may include any one of the following elements, alone or in combination with each other:

- A flipper mechanism mounted adjacent or in proximity to the cement head sub, the flipper mechanism comprising a movable extension protruding into the bore at a location below the select location of the first plug chamber, a flipper controller operable to move the arm and visual indicator linked to the movable arm, wherein the flipper controller is in communication with the control base station.
- Each of the controllers is in wireless communication with the base station.
- A second plug chamber in communication with the inner bore at a select location along the bore; and a second plug release system comprising a movable plug release element disposed adjacent or in proximity to the second plug chamber, a second plug release controller operable to move the plug release element from a first position in which the plug chamber is closed and a second position in which the second plug chamber is open, and visual indicator linked to the movable release element, wherein the second plug release controller is in communication with the control base station.

The cement head sub further comprises a fluid bypass passage extending substantially parallel with the bore, the bypass passage having a first port in fluid communication with the bore above the select location of the first plug chamber.

A movable plug release element of the first plug release system has a fluid flow passage therethrough which forms a fluid communication path between the bypass passage and the bore when the first plug release is in the first position and blocks fluid communication therethrough when first plug release is in the second position.

A first plug chamber comprises a portion of the bore and the movable plug release element is a rotatable cylinder having a radial through bore disposed to substantially align with the bore of the cement head sub when the movable plug release element is in the second position.

A first safety valve system disposed adjacent or in proximity to the cement head sub so as to be in fluid communication with the inner bore, the safety valve system comprising a movable safety valve element, a safety valve controller operable to move the movable safety valve element and visual indicator linked to the movable safety valve element, wherein the safety valve controller is in communication with the control base station.

An additional plug chamber in communication with the inner bore at a select location along the bore below the flipper; and an additional plug release system comprising a movable plug release element disposed adjacent or in proximity to the additional plug chamber, an additional plug release controller operable to move the plug release element thereof from a first position in which the additional plug chamber is closed and a second position in which the additional plug chamber is open, and visual indicator linked to the movable release element, wherein the additional plug release controller is in communication with the control base station.

The first safety valve system is disposed above the first plug chamber, the cement head system further comprising a second safety valve system disposed adjacent or in proximity to the cement head sub so as to be in fluid communication with the inner bore below the first plug chamber, the second safety valve system comprising a movable safety valve element, a safety valve controller operable to move the movable safety valve element and visual indicator linked to the movable safety valve element, wherein the second safety valve controller is in communication with the control base station.

A cement slurry swivel to which the cement slurry valve is attached, the cement slurry swivel comprising a sleeve rotatably mounted on elongated tubular, the sleeve having a port therein that aligns with a bore of the cement slurry valve, the sleeve having a circumferentially extending cavity defined along a portion of the inner surface of sleeve and in fluid communication with the port, wherein an inlet in fluid communication with the inner bore is defined in the elongated tubular, the inlet in fluid communication with the circumferentially extending cavity.

A second cement slurry valve in fluid communication with the inner bore, the second cement slurry valve comprising a movable valve element, a second slurry valve controller operable to move the valve element and visual indicator linked to the movable valve element, wherein the second cement slurry valve controller is in communication with the control base station.

A first plug disposed in the first plug chamber.

A flipper mechanism mounted adjacent or in proximity to the cement head sub, the flipper mechanism comprising a movable visual indicator and, a flipper controller operable to move the visual indicator, wherein the flipper controller is in communication with the control base station.

The visual indicator of the flipper mechanism is operable by a magnetic or RFID trigger mechanism.

A flipper mechanism comprises a movable extension protruding into the bore at a location below the first and second plug chambers.

A first safety valve system and a second safety valve system, each safety valve system disposed adjacent or in proximity to the cement head sub so as to be in fluid communication with the inner bore, and each safety valve system comprising a movable safety valve element, a safety valve controller operable to move the movable safety valve element and visual indicator linked to the movable safety valve element, one of the safety valve system positioned above the first and second plug chambers and the other safety valve system positioned below the flipper mechanism, wherein the safety valve controllers are in communication with the control base station.

A second cement slurry valve in fluid communication with the inner bore, the second cement slurry valve comprising a movable valve element, a second slurry valve controller operable to move the valve element and visual indicator linked to the movable valve element, wherein the second cement slurry valve controller is in communication with the control base station, wherein each of the cement slurry valves is attached to a cement slurry swivel comprising a sleeve rotatably mounted on the elongated tubular, the sleeve having a ports therein that each align with a bore of a cement slurry valve, the sleeve having a circumferentially extending cavity defined along a portion of the inner surface of sleeve and in fluid communication with the ports, wherein an inlet in fluid communication with the inner bore is defined in the elongated tubular, the inlet in fluid communication with the circumferentially extending cavity.

The base station comprises a computer processor and non-transitory storage medium accessible by the processor and cementing control software instructions stored on the storage medium and executable by the processor for: initiating a control sequence with a base station; actuating a first cement slurry valve visual indicator at the cement head by opening a first cement slurry valve to establish fluid communication between the first cement slurry valve and the cement head; releasing a first plug from a first plug chamber associated with the cement head to actuate a first plug release visual indicator at the cement head; actuating a flipper mechanism visual indicator at the cement head by passing the first plug in proximity to the flipper mechanism; following actuation of the flipper mechanism visual indicator by the first plug, resetting the flipper mechanism visual indicator to an unactuated position;

releasing a second plug from a second plug chamber associated with the cement head to actuate a second plug release visual indicator at the cement head; and actuating the flipper mechanism visual indicator by passing the second plug in proximity to the flipper mechanism.

The base station is a computer implemented system comprising a processor, a non-transitory storage medium accessible by the processor; and cementing control sequence software instructions stored on the storage medium and executable by the processor for: actuating a safety valve visual indicator adjacent the cement head by opening the safety valve positioned below the cement head to establish fluid communication between the safety valve and the cement head; actuating a first cement slurry valve visual indicator at the cement head by opening a first cement slurry valve to establish fluid communication between the first cement slurry valve and the cement head; releasing a first plug from a first plug chamber associated with the cement head to actuate a first plug release visual indicator at the cement head; actuating a flipper mechanism visual indicator at the cement head by passing the first plug in proximity to the flipper mechanism; pumping cement slurry through the cement slurry valves into the cement head following the first actuation of the flipper mechanism visual indicator; following actuation of the flipper mechanism visual indicator by the first plug, resetting the flipper mechanism visual indicator to an unactuated position; releasing a second plug from a second plug chamber associated with the cement head to actuate a second plug release visual indicator at the cement head; actuating the flipper mechanism visual indicator by passing the second plug in proximity to the flipper mechanism; once the second plug has been released, pumping a displacement fluid into the cement head; flushing the cement head by using the base station to actuate the second plug release system to drive the second plug release system between a first open plug chamber configuration and a second closed plug configuration while a flush fluid is passed through the cement head, and using the base station to actuate the first plug release system to drive the first plug release system between a first open plug chamber configuration and a second closed plug configuration while the flush fluid is passed through the cement head; and maintaining dynamic fluid flow through the cement head during the transition between at least two different fluids during at least a portion of the control sequence.

A cementing method for a wellbore has been described. Embodiments of the cementing method may include initiating a control sequence with a base station; actuating a first cement slurry valve visual indicator at the cement head by opening a first cement slurry valve to establish fluid communication between the first cement slurry valve and the cement head; releasing a first plug from a first plug chamber associated with the cement head to actuate a first plug release visual indicator at the cement head; actuating a flipper mechanism visual indicator at the cement head by passing the first plug in proximity to the flipper mechanism; following actuation of the flipper mechanism visual indicator by the first plug, resetting the flipper mechanism visual indicator to an unactuated position; releasing a second plug from a second plug chamber associated with the cement head to actuate a second plug release visual indicator at the cement head; and actuating the flipper mechanism visual indicator by passing the second plug in proximity to the flipper mechanism. For any of the foregoing embodiments, the method may include any one of the following steps, alone or in combination with each other:

Actuating a second cement slurry valve visual indicator of a second cement slurry valve in fluid communication with the cement head by opening the second cement slurry valve to establish fluid communication between the second cement slurry valve and the cement head; actuating a first safety valve visual indicator by opening a first safety valve positioned above the cement head to establish fluid communication between the first safety valve and the cement head; actuating a second safety valve visual indicator by opening a second safety valve positioned below the cement head to establish fluid communication between the second safety valve and the cement head; prior to release of the second plug, pumping cement slurry through the cement slurry valves into the cement head following the first actuation of the flipper visual indicator and causing the cement slurry to bypass the second plug chamber; once the second plug has been released, pumping a flush fluid into the cement head; following release of the second plug, flushing the cement head by actuating the second plug release system to drive the second plug release system between a first open plug chamber configuration and a second closed plug configuration while the flush fluid is passing through the cement head, and actuating the first plug release system to drive the first plug release system between a first open plug chamber configuration and a second closed plug configuration while the flush fluid is passing through the cement head; and following flushing of the cement head, actuating the first and second cement slurry valves to close the valves, actuating the first and second safety valves to close the safety valves and actuating the first and second plug release systems to close the plug release systems.

Actuating a first safety valve visual indicator by opening a first safety valve positioned above the cement head to establish fluid communication between the first safety valve and the cement head; and actuating a second safety valve visual indicator by opening a second safety valve positioned below the cement head to establish fluid communication between the second safety valve and the cement head.

Prior to release of the second plug, pumping cement slurry through the cement slurry valve into the cement head following the first actuation of the flipper visual indicator and causing the cement slurry to bypass the second plug chamber; and once the second plug has been released, pumping a flush fluid into the cement head.

Following release of the second plug, actuating the second plug release system to drive the second plug release system between a first open plug chamber configuration and a second closed plug configuration while the flush fluid is passing through the cement head, and actuating the first plug release system to drive the first plug release system between a first open plug chamber configuration and a second closed plug configuration while the flush fluid is passing through the cement head.

Each plug release system is opened and closed at least twice while passing flush fluid through the cement head.

The control sequence is initiated by utilizing a wireless signal to communicate with one or more wireless controllers in order to actuate the slurry valve, to release the plugs and to reset the flipper visual indicator.

Dynamic fluid flow through the cement head is maintained during the transition between at least two different fluids during at least a portion of the control sequence.

Dynamic fluid flow is maintained through the cement head during the transition between release of the cement slurry and pumping of the displacement fluid.

Dynamic fluid flow is maintained through the cement head during the transition between pumping of the displacement fluid and passing of a flush fluid through the cement head.

A portion of at least two of the steps of opening, releasing, pumping and flushing occur simultaneously.

Although various embodiments and methods have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

The invention claimed is:

1. A cement head system for wellbores comprising:

a cement head sub comprising an elongated tubular having an inner bore extending therethrough;

a first plug chamber in communication with the inner bore at a select location along the bore;

a first plug release system comprising a movable plug release element disposed adjacent the first plug chamber, a first plug release controller operable to move the plug release element from a first position in which the first plug chamber is closed and a second position in which the first plug chamber is open, and visual indicator linked to the movable release element;

a first cement slurry valve in fluid communication with the inner bore, the first cement slurry valve comprising a movable valve element, a first slurry valve controller operable to move the valve element and visual indicator linked to the movable valve element;

a control base station in communication with the slurry valve controller and the plug release controller;

a flipper mechanism mounted in proximity to the cement head sub, the flipper mechanism comprising a movable extension protruding into the bore at a location below the select location of the first plug chamber, and a flipper controller operable to move the arm and visual indicator linked to the movable arm, wherein the flipper controller is in communication with the control base station; and a second plug chamber in communication with the inner bore at a select location along the bore; and a second plug release system comprising a movable plug release element disposed adjacent the second plug chamber, a second plug release controller operable to move the movable plug release element from a first position in which the second plug chamber is closed and a second position in which the second plug chamber is open, and a visual indicator linked to the movable plug release element, wherein the second plug release controller is in communication with the control base station, wherein prior to release of the second plug, cement slurry is pumped through the cement slurry valve into the cement head following the first actuation of the flipper visual indicator and causing the cement slurry to bypass the second plug chamber; and wherein once the second plug has been released, one of a flush fluid or displacement fluid is pumped into the cement head.

2. The cement head system of claim 1, wherein each of the controllers is in wireless communication with the base station.

3. The cement head system of claim 1, wherein the cement head sub further comprises a fluid bypass passage extending substantially parallel with the bore, the bypass passage having a first port in fluid communication with the bore above the select location of the first plug chamber.

4. The cement head system of claim 3, wherein the movable plug release element of the first plug release system has a fluid flow passage therethrough which forms a fluid communication path between the bypass passage and the bore when the first plug release is in the first position and blocks fluid communication therethrough when first plug release is in the second position.

5. The cement head system of claim 4, wherein the first plug chamber comprises a portion of the bore and the movable plug release element is a rotatable cylinder having a radial through bore disposed to substantially align with the bore of the cement head sub when the movable plug release element is in the second position.

6. The cement head system of claim 1, further comprising a first safety valve system disposed in proximity to the cement head sub so as to be in fluid communication with the inner bore, the safety valve system comprising a movable safety valve element, a safety valve controller operable to move the movable safety valve element and visual indicator linked to the movable safety valve element, wherein the safety valve controller is in communication with the control base station.

7. The cement head system of claim 1, further comprising an additional plug chamber in communication with the inner bore at a select location along the bore below the flipper; and an additional plug release system comprising a movable plug release element disposed adjacent the additional plug chamber, an additional plug release controller operable to move the plug release element thereof from a first position in which the additional plug chamber is closed and a second position in which the additional plug chamber is open, and visual indicator linked to the movable release element, wherein the additional plug release controller is in communication with the control base station.

8. A cement head system for wellbores comprising:

a cement head sub comprising an elongated tubular having an inner bore extending therethrough and a fluid bypass passage extending substantially parallel with the bore, the bypass passage having a first port in fluid communication with the bore;

a first plug chamber and a second plug chamber, each formed by a portion of the inner bore at distinct select locations along the bore, wherein the first chamber is above the second chamber;

a first plug release system adjacent the first chamber and a second plug release system adjacent the second chamber, each plug release system comprising a movable plug release element disposed adjacent the respective plug chamber, a plug release controller operable to move the associated plug release element from a first position in which the associated plug chamber is closed and a second position in which the associated plug chamber is open, and visual indicator linked to the associated movable release element, wherein each movable plug release element is a rotatable cylinder having a radial through bore disposed to substantially align with the inner bore of the cement head sub when the associated movable plug release element is in the second position, the rotable cylinder further including a fluid flow passage therethrough which forms a fluid communication path between the bypass passage and the inner bore when the plug release is in the first position and blocks fluid communication therethrough when first release is in the second position;

a first cement slurry valve in fluid communication with the inner bore, the first cement slurry valve comprising a movable valve element, a first slurry valve controller operable to move the valve element and visual indicator linked to the movable valve element;

a flipper mechanism mounted in proximity to the cement head sub, the flipper mechanism comprising a movable visual indicator and a flipper controller operable to move the visual indicator; and a control base station in wireless communication with the slurry valve controller, the flipper controller and the plug release controllers, wherein the base controller is a computer implemented system comprising a processor, a non-transitory storage medium accessible by the processor, and cementing control sequence software instructions stored on the storage medium and executable by the processor for:

actuating a safety valve visual indicator adjacent the cement head by closing a safety valve positioned above the cement head to prevent fluid communication between the safety valve and the cement head or actuating a safety valve visual indicator adjacent the cement head by opening a safety valve positioned above the cement head to establish fluid communication between the first safety valve and the cement head;

actuating the first cement slurry valve visual indicator at the cement head by opening the first cement slurry valve to establish fluid communication between the first cement slurry valve and the cement head;

releasing a first plug from a first plug chamber associated with the cement head to actuate a first plug release visual indicator at the cement head;

actuating the flipper mechanism visual indicator at the cement head by passing the first plug in proximity to the flipper mechanism;

pumping cement slurry through the cement slurry valves into the cement head following the first actuation of the flipper mechanism visual indicator;

following actuation of the flipper mechanism visual indicator by the first plug, resetting the flipper mechanism visual indicator to an unactuated position;

releasing a second plug from a second plug chamber associated with the cement head to actuate a second plug release visual indicator at the cement head;

actuating the flipper mechanism visual indicator by passing the second plug in proximity to the flipper mechanism;

once the second plug has been released, pumping a displacement fluid into the cement head;

flushing the cement head by using the base station to actuate the second plug release system to drive the second plug release system between a first open plug chamber configuration and a second closed plug configuration while a flush fluid is passed through the cement head, and using the base station to actuate the first plug release system to drive the first plug release system between a first open plug chamber configuration and a second closed plug configuration while the flush fluid is passed through the cement head; and maintaining dynamic fluid flow through the cement head during the transition between at least two different fluids during at least a portion of the control sequence.

9. The cement head system of claim 8, further comprising a first safety valve system and a second safety valve system, each safety valve system disposed in proximity to the cement head sub so as to be in fluid communication with the inner bore, and each safety valve system comprising a movable safety valve element, a safety valve controller operable to move the movable safety valve element and visual indicator linked to the movable safety valve element, one of the safety valve system positioned above the first and second plug chambers and the other safety valve system positioned below the flipper mechanism, wherein the safety valve controllers are in communication with the control base station.

10. The cement head system of claim 8, further comprising an additional plug chamber in communication with the inner bore at a select location along the bore below the flipper mechanism; and an additional plug release system comprising a movable plug release element disposed adjacent the additional plug chamber, an additional plug release controller operable to move the plug release element thereof from a first position in which the additional plug chamber is closed and a second position in which the additional plug chamber is open, and visual indicator linked to the movable release element, wherein the additional plug release controller is in communication with the control base station.

11. The cement head system of claim 8, further comprising a second cement slurry valve in fluid communication with the inner bore, the second cement slurry valve comprising a movable valve element, a second slurry valve controller operable to move the valve element and visual indicator linked to the movable valve element, wherein the second cement slurry valve controller is in communication with the control base station, wherein each of the cement slurry valves is attached to a cement slurry swivel comprising a sleeve rotatably mounted on the elongated tubular, the sleeve having a ports therein that each align with a bore of a cement slurry valve, the sleeve having a circumferentially extending cavity defined along a portion of the inner surface of sleeve and in fluid communication with the ports, wherein an inlet in fluid communication with the inner bore is defined in the elongated tubular, the inlet in fluid communication with the circumferentially extending cavity.

12. A cementing method for a wellbore comprising:

initiating a control sequence with a base station;

actuating a first cement slurry valve visual indicator at the cement head by opening a first cement slurry valve to establish fluid communication between the first cement slurry valve and the cement head;

releasing a first plug from a first plug chamber associated with the cement head to actuate a first plug release visual indicator at the cement head;

actuating a flipper mechanism visual indicator at the cement head by passing the first plug in proximity to the flipper mechanism;

following actuation of the flipper mechanism visual indicator by the first plug, resetting the flipper mechanism visual indicator to an unactuated position;

releasing a second plug from a second plug chamber associated with the cement head to actuate a second plug release visual indicator at the cement head;

actuating the flipper mechanism visual indicator by passing the second plug in proximity to the flipper mechanism;

actuating a first safety valve visual indicator adjacent the cement head by closing a first safety valve positioned above the cement head to prevent fluid communication between the first safety valve and the cement head or actuating a first safety valve visual indicator adjacent the cement head by opening a first safety valve positioned above the cement head to establish fluid communication between the first safety valve and the cement head;

actuating a second safety valve visual indicator adjacent the cement head by opening a second safety valve positioned below the cement head to establish fluid communication between the second safety valve and the cement head;

prior to release of the second plug, pumping cement slurry through the cement slurry valves into the cement head following the first actuation of the flipper mechanism visual indicator and causing the cement slurry to bypass the second plug chamber;

once the second plug has been released, pumping a displacement fluid into the cement head;

following release of the second plug, flushing the cement head by using the base station to actuate the second plug release system to drive the second plug release system between a first open plug chamber configuration and a second closed plug configuration while a flush fluid is passed through the cement head, and using the base station to actuate the first plug release system to drive the first plug release system between a first open plug chamber configuration and a second closed plug configuration while the flush fluid is passed through the cement head; and following flushing of the cement head, using the base station to actuate the first and second cement slurry valves to close the valves, and to actuate the first and second safety valves to close the safety valves and to actuate the first and second plug release systems to close the plug release systems.

13. The method of claim 12, wherein dynamic fluid flow through the cement head is maintained during the transition between at least two different fluids during at least a portion of the control sequence.

14. The method of claim 13, wherein dynamic fluid flow is maintained through the cement head during the transition between release of the cement slurry and pumping of the displacement fluid.

15. The method of claim 14, wherein dynamic fluid flow is maintained through the cement head during the transition between pumping of the displacement fluid and passing of a flush fluid through the cement head.

16. The method of claim 15, wherein a portion of at least two of the steps of opening, releasing, pumping and flushing occur simultaneously.

17. The method of claim 12, wherein the control sequence is initiated by utilizing a wireless signal to communicate with one more wireless controllers to actuate the slurry valve, to release the plugs and to reset the flipper visual indicator.

18. A cementing method for a wellbore comprising:

initiating a control sequence with a base station;

actuating a first cement slurry valve visual indicator at the cement head by opening a first cement slurry valve to establish fluid communication between the first cement slurry valve and the cement head;

releasing a first plug from a first plug chamber associated with the cement head to actuate a first plug release visual indicator at the cement head;

actuating a flipper mechanism visual indicator at the cement head by passing the first plug in proximity to the flipper mechanism;

following actuation of the flipper mechanism visual indicator by the first plug, resetting the flipper mechanism visual indicator to an unactuated position;

releasing a second plug from a second plug chamber associated with the cement head to actuate a second plug release visual indicator at the cement head;

actuating the flipper mechanism visual indicator by passing the second plug in proximity to the flipper mechanism; and prior to release of the second plug, pumping cement slurry through the cement slurry valve into the cement head following the first actuation of the flipper visual indicator and causing the cement slurry to bypass the second plug chamber; and once the second plug has been released, pumping a flush fluid into the cement head.

19. The method of claim 18, further comprising: following release of the second plug, actuating the second plug release system to drive the second plug release system between a first open plug chamber configuration and a second closed plug configuration while the flush fluid is passing through the cement head, and actuating the first plug release system to drive the first plug release system between a first open plug chamber configuration and a second closed plug configuration while the flush fluid is passing through the cement head.

20. The method of claim 19, wherein each plug release system is opened and closed at least twice while passing flush fluid through the cement head.

21. The method of claim 18, wherein the control sequence is initiated by utilizing a wireless signal to communicate with one more wireless controllers to actuate the slurry valve, to release the plugs and to reset the flipper visual indicator.

* * * * *